US007194771B2

(12) United States Patent
Chou

(10) Patent No.: US 7,194,771 B2
(45) Date of Patent: Mar. 27, 2007

(54) FRAME/LENS COMBINATION FOR SWIMMING GOGGLES

(76) Inventor: Terry Chou, No. 12, Hsin Ho Herng Rd., Tainan City (TW)

( * ) Notice: Subject to any disclaimer, the term of this patent is extended or adjusted under 35 U.S.C. 154(b) by 44 days.

(21) Appl. No.: 10/892,684

(22) Filed: Jul. 15, 2004

(65) Prior Publication Data

US 2006/0010586 A1 Jan. 19, 2006

(51) Int. Cl.
*A61F 9/02* (2006.01)

(52) U.S. Cl. ..... 2/428; 2/448

(58) Field of Classification Search ..... 2/426, 2/428, 448

See application file for complete search history.

(56) References Cited

U.S. PATENT DOCUMENTS 6,052,834 A * 4/2000 Chou ..... 2/428
6,343,386 B1 * 2/2002 Chou ..... 2/428
6,473,909 B1 * 11/2002 Chou ..... 2/428
6,499,148 B2 * 12/2002 Chou ..... 2/428
6,516,474 B2 * 2/2003 Chou ..... 2/428
6,647,557 B2 * 11/2003 Chou ..... 2/442
6,711,754 B2 * 3/2004 Chou ..... 2/428

* cited by examiner

*Primary Examiner*—Katherine Moran
(74) *Attorney, Agent, or Firm*—Charles E. Baxley

(57) ABSTRACT

A frame/lens combination includes a rigid frame with stretching resistance and a rigid lens with stretching resistance. The frame is annular and includes an opening having an extension that tapers outward to form a tapered end section. A perimeter wall delimiting the opening includes an outer section that delimits the tapered end section. The outer section is engaged with an associated end of a head strap. The lens is held in the opening of the frame. The tapered end section of the extension has a width smaller than that of the lens. The perimeter wall of the frame includes at least one engaging member, and the lens includes at least one engaging groove for receiving the engaging member. The lens further includes an outer inclined section for reducing swimming resistance.

8 Claims, 11 Drawing Sheets

FRAME/LENS COMBINATION FOR SWIMMING GOGGLES

BACKGROUND OF THE INVENTION

1. Field of the Invention

The present invention relates to a frame/lens combination for a pair of swimming goggles. In particular, the present invention relates to a combination of a frame and a lens for forming a pair of swimming goggles with improved assembling convenience, improved utility, and reduced swimming resistance.

2. Description of the Related Art

FIGS. 7 and 8 of the drawings illustrate a pair of conventional swimming goggles comprising a frame 1' made of a rigid material with excellent stretching resistance and including two ring portions 11' for respectively holding two lenses 2'. Each ring portion 11' includes two engaging members 111' for engaging with the lenses 2'. Each ring portion 11' further includes an outer side 12' with an engaging portion 13' for engaging with an associated end of a head strap 3'. Each lens 2' is made of a rigid material with excellent stretching resistance and includes a front portion 21' and an annular rear portion 22' for engaging with an associated eye socket of a user, with the annular rear portion 22' including an inclined outer section 23'. Each lens 2' further includes two openings 24' for engaging with the engaging members 111' of the associated ring portion 11'.

As illustrated in FIG. 8, when in assembly, force is applied to engage the lenses 2' with the ring portions 11' and the engaging members 111' are engaged with the openings 24'. Each end of the head strap 3' is engaged with the engaging portion 13' of the outer side 12' of the associated ring portion 11'. A soft padding member 4' is coupled to an inner side of each lens 2'.

The frame 1' and the lenses 2' are made of a relatively rigid material, providing the engaging member 111' with sufficient strength to reliably engage with the openings 24'. However, the rigid material results in unsatisfactory flexibility of the frame 1'. As a result, it is difficult to stretch and expand each ring portion 11' for mounting the associated lens 2' and the ring portions 11' are apt to break. Further, the outer side 12' of each ring portion 11' must extend to a length sufficient for engaging with the associated end of the head strap 3', resulting in resistance while swimming.

FIGS. 9 and 10 illustrate another pair of conventional swimming goggles comprising a rigid frame 5' with two ring portions, two lens holding members 6', and two lenses 7'. Each ring portion of the rigid frame 5' includes a notch 51' in an outer side thereof for engaging with a rigid block 52'. Each lens holding member 6' includes a connecting block 61' for engaging with an associated ring portion. Each lens 7' is held in a front end of the associated lens holding member 6'. Although each lens holding member 6' can be engaged with the associated ring portion of the frame 5' by means of stretching the associated ring portion at the notch 51', a rigid block 52' is required and the assembling procedure is inconvenient.

FIG. 11 is an exploded perspective view of a further pair of conventional swimming goggles comprising a frame 8' including two ring portions 81' each having two engaging grooves 811' (only one is shown) for holding an associated rigid lens 9'. Each ring portion 81' includes an outer side 82' having a recessed portion 83' for coupling with a block 90'. Each lens 9' includes two engaging members 91' (only one is shown) for engaging with the engaging grooves 811' and an engaging portion 92' for engaging with the associated block 90', with an associated end of the head strap 93' being engaged with the block 90'. The blocks 90' are mounted after the lenses 9' are forcibly inserted into the ring portions 81'. However, it is difficult to stretch and expand the ring portions 81' of the rigid frame 8' when assembling the lenses 9'. Additional cost is required for manufacturing the blocks 90', and mounting of the blocks 90' requires additional time. Further, the outer side 82' of each ring portion 81' must extend to a length sufficient for engaging with the associated end of the head strap 93', resulting in resistance while swimming.

SUMMARY OF THE INVENTION

An object of the present invention is to provide a frame/lens combination for forming a pair of swimming goggles with improved assembling convenience, improved utility, and reduced swimming resistance.

In accordance with an aspect of the invention, a frame/lens combination comprises a rigid frame with stretching resistance and a rigid lens with stretching resistance. The frame is annular and includes an opening having an extension that tapers outward to form a tapered end section. A perimeter wall delimiting the opening includes an outer section that delimits the tapered end section. The outer section is engaged with an associated one of two ends of a head strap. The lens is held in the opening of the frame.

The tapered end section of the extension has a width smaller than that of the lens. The perimeter wall of the frame includes at least one engaging member, and the lens includes at least one engaging groove for receiving the engaging member. The lens further includes an outer inclined section for reducing swimming resistance.

In accordance with another aspect of the invention, a pair of swimming goggles comprises two rigid frames with stretching resistance, the frames being connected with each other, and two rigid lenses with stretching resistance. Each frame is annular and includes an opening having an extension that tapers outward to form a tapered end section. A perimeter wall delimiting the opening includes an outer section that delimits the tapered end section. The outer section is engaged with an associated one of two ends of a head strap. Each lens is held in the opening of an associated one of the frames.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
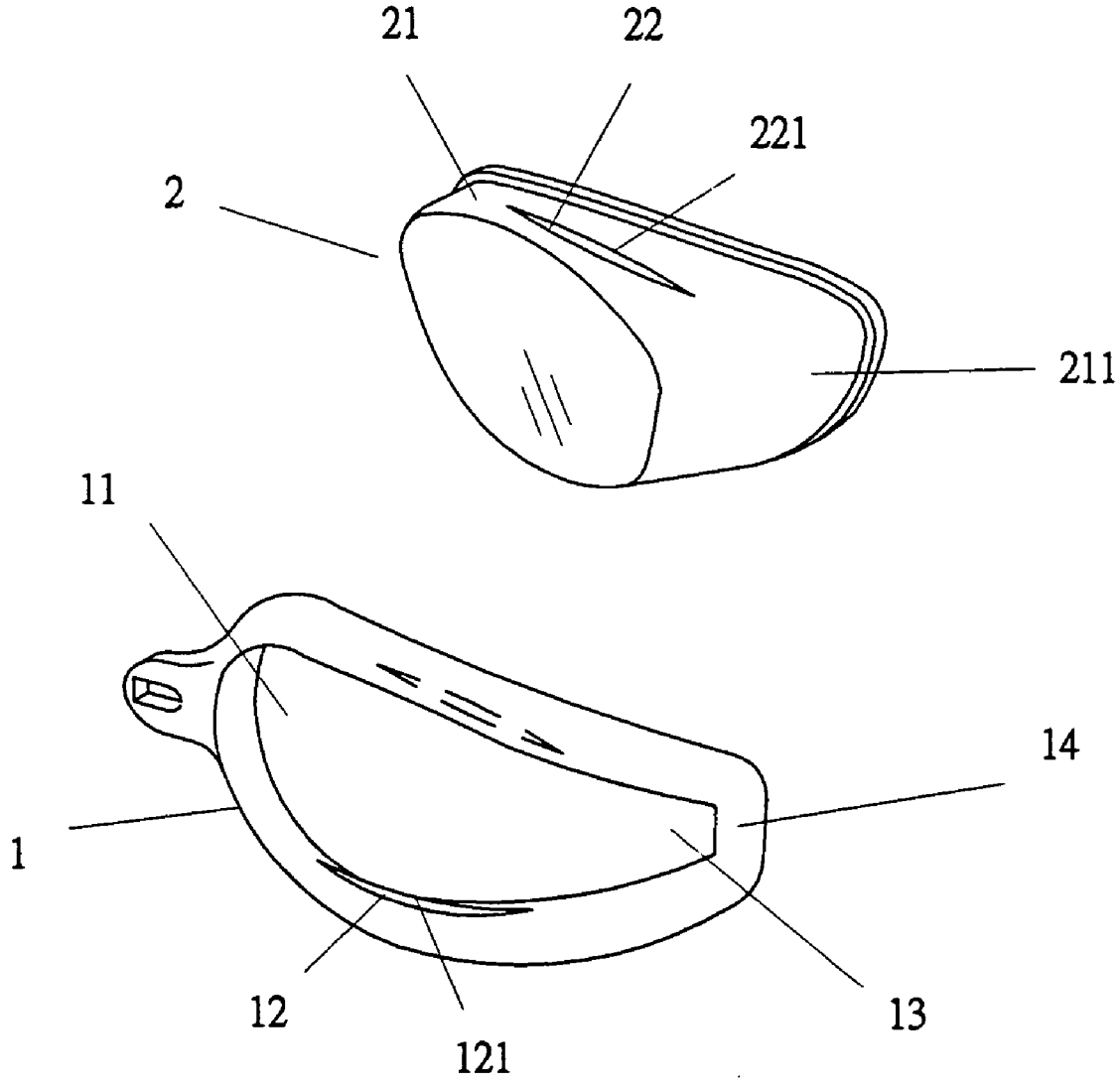
FIG. 1 is an exploded perspective view of a frame/lens combination for a pair of swimming goggles in accordance with the present invention.
Figure 2:
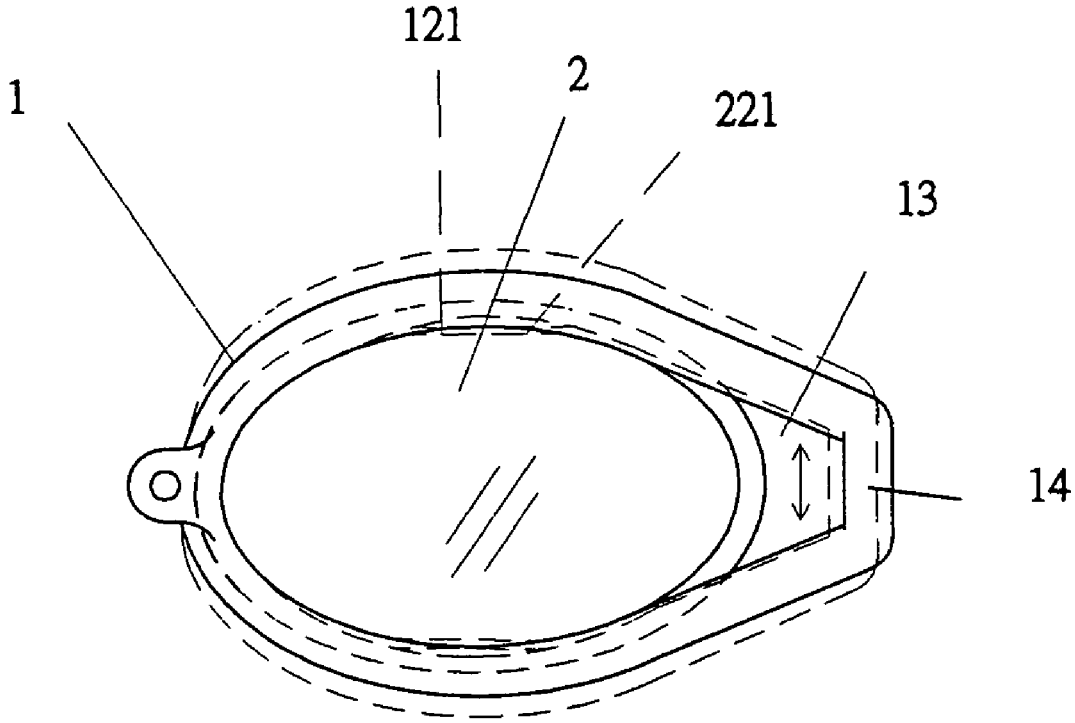
FIG. 2 is a front view illustrating assembling of the frame and the lens in FIG. 1.

Referring to FIGS. 1 and 2, a frame/lens combination in accordance with the present invention comprises a rigid frame 1 with excellent stretching resistance and a rigid lens 2 also with excellent stretching resistance. The frame 1 is substantially annular and includes an opening 11 for holding an associated lens 2. A perimeter wall delimiting the opening 11 includes at least one engaging section 12 (two in this embodiment) with an engaging member 121. The opening 11 includes an extension 13 in an outer end thereof, with the extension 13 tapering outward to form a tapered end section with a width smaller than that of the associated lens 2. The perimeter wall delimiting the opening 11 includes an outer section 14 that delimits the tapered end section of the extension 13, with an end of a head strap 3 being engaged with the outer section 14, as shown in FIG. 4.

The lens 2 includes an annular section 21 for engaging with an eye socket of a user. The annular section 21 includes an outer inclined section 211. Further, the annular section 21 includes at least one engaging portion 22 (two in this embodiment) in an outer surface thereof, with the engaging portion 22 having an engaging groove 221.

Figure 3:
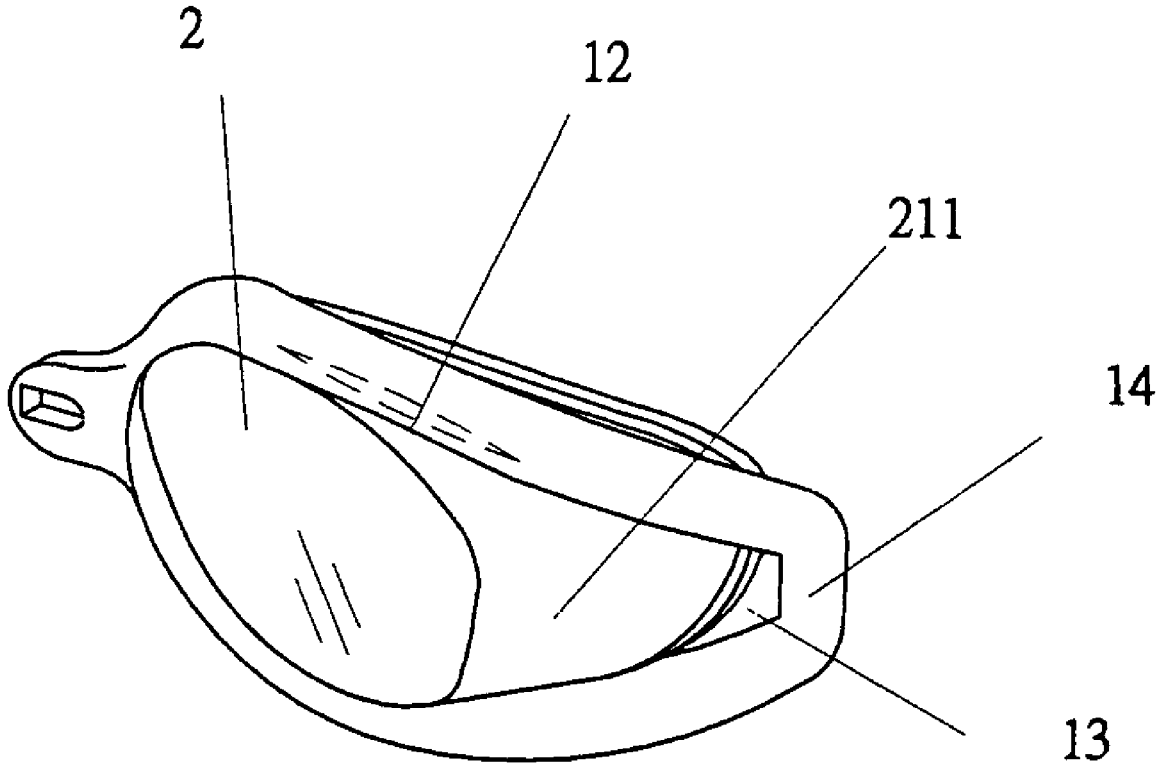
FIG. 3 is a perspective view of the frame/lens combination after assembly.

As illustrated in FIGS. 2 and 3, the frame 1 is stretched outward to enlarge the opening 11, particularly the extension 13 of the opening 11, allowing insertion of the lens 2 into the opening 11. Since the extension 13 tapers outward, outward movement of the lens 2 is prevented after assembly of the lens 2 and the frame 1. Further, the engaging members 121 of the frame 1 are respectively engaged with the engaging grooves 221 of the lens 2. Thus, the lens 2 is reliably held in the frame 1.

Figure 4:
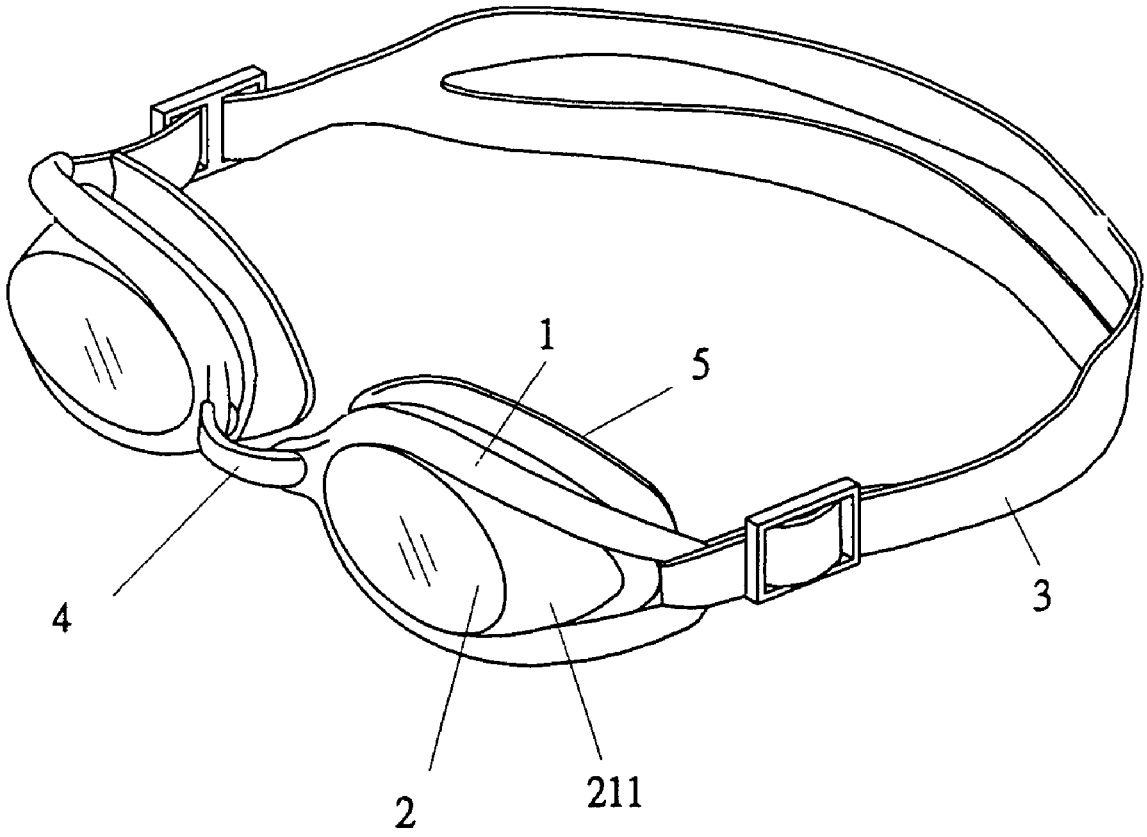
FIG. 4 is a perspective view of a pair of swimming goggles with frame/lens combinations in accordance with the present invention.

Referring to FIG. 4, two frame/lens combinations are interconnected by a bridge 4, each end of a head strap 3 wraps around and is thus engaged with the outer section 14 of each frame/lens combination, and a soft padding member 5 is mounted to a rear side of each lens 2, forming a pair of swimming goggles. The head strap 3 can be assembled in a convenient manner, and the total number of elements of the pair of swimming goggles is reduced.

Figure 5:
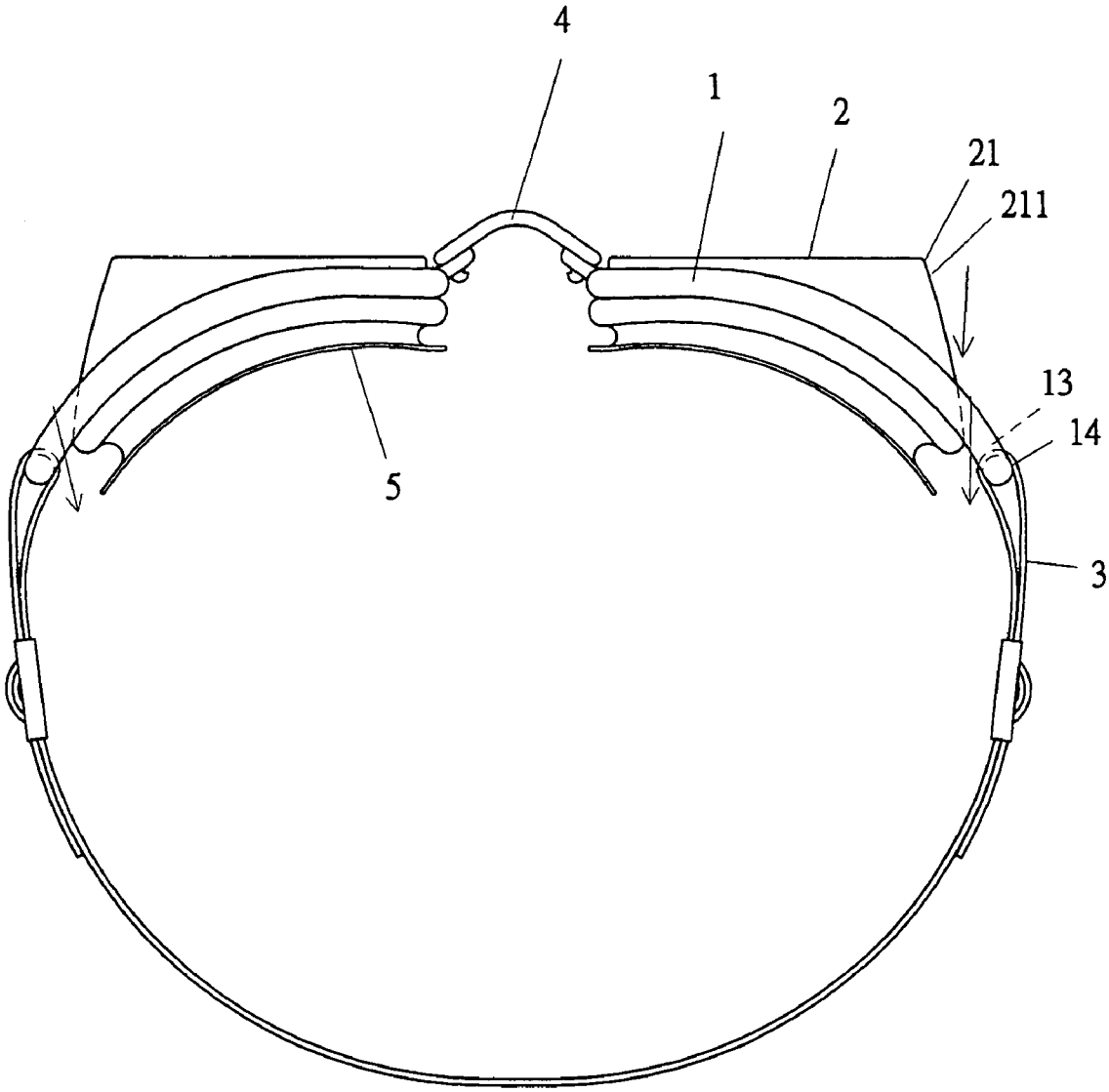
FIG. 5 is a top view of the pair of swimming goggles in FIG. 4.

Referring to FIG. 5, when a user of the pair of the swimming goggles is swimming, the swimming resistance is reduced, as water is guided by the outer inclined section 211 of each lens 2.

Figure 6:
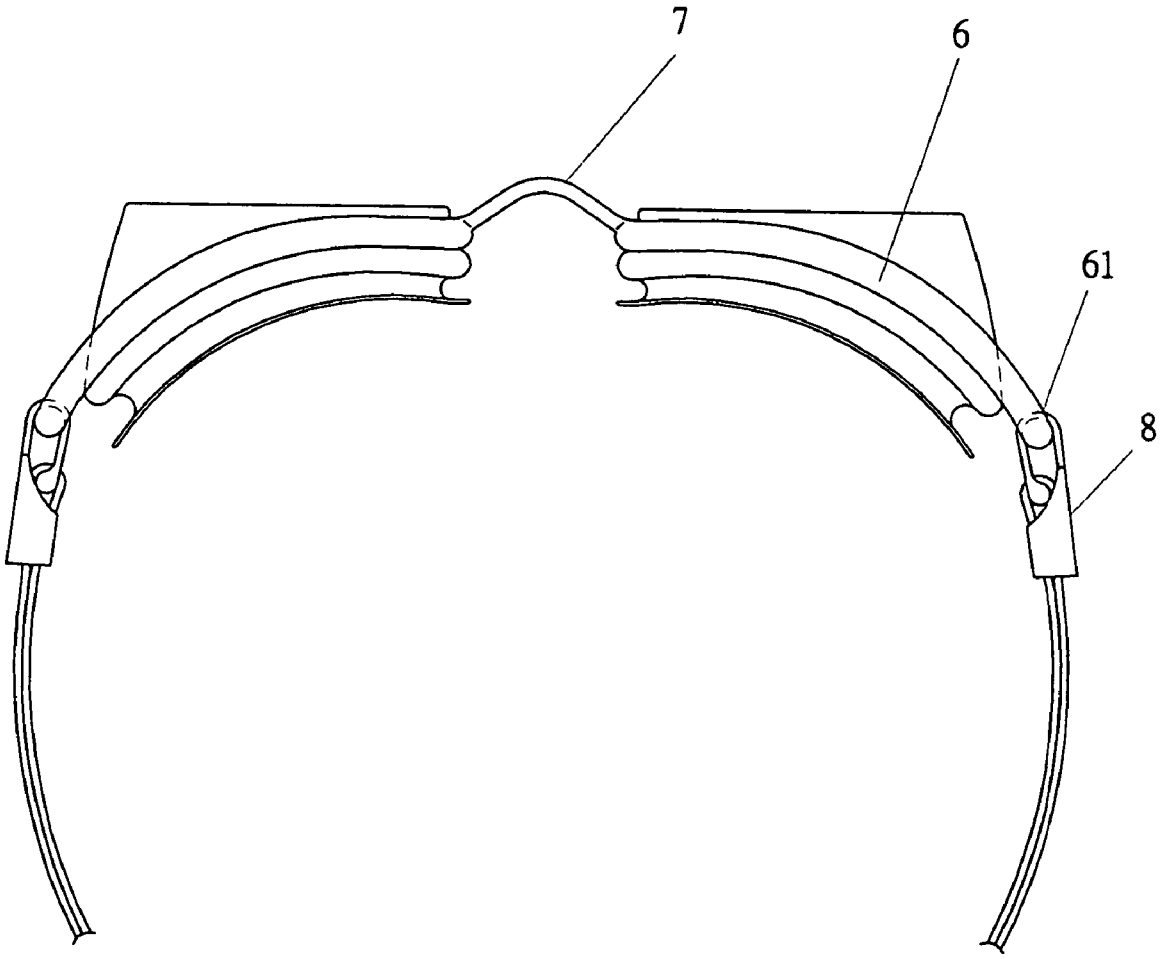
FIG. 6 is a top view of a modified embodiment in accordance with the present invention.
Figure 7:
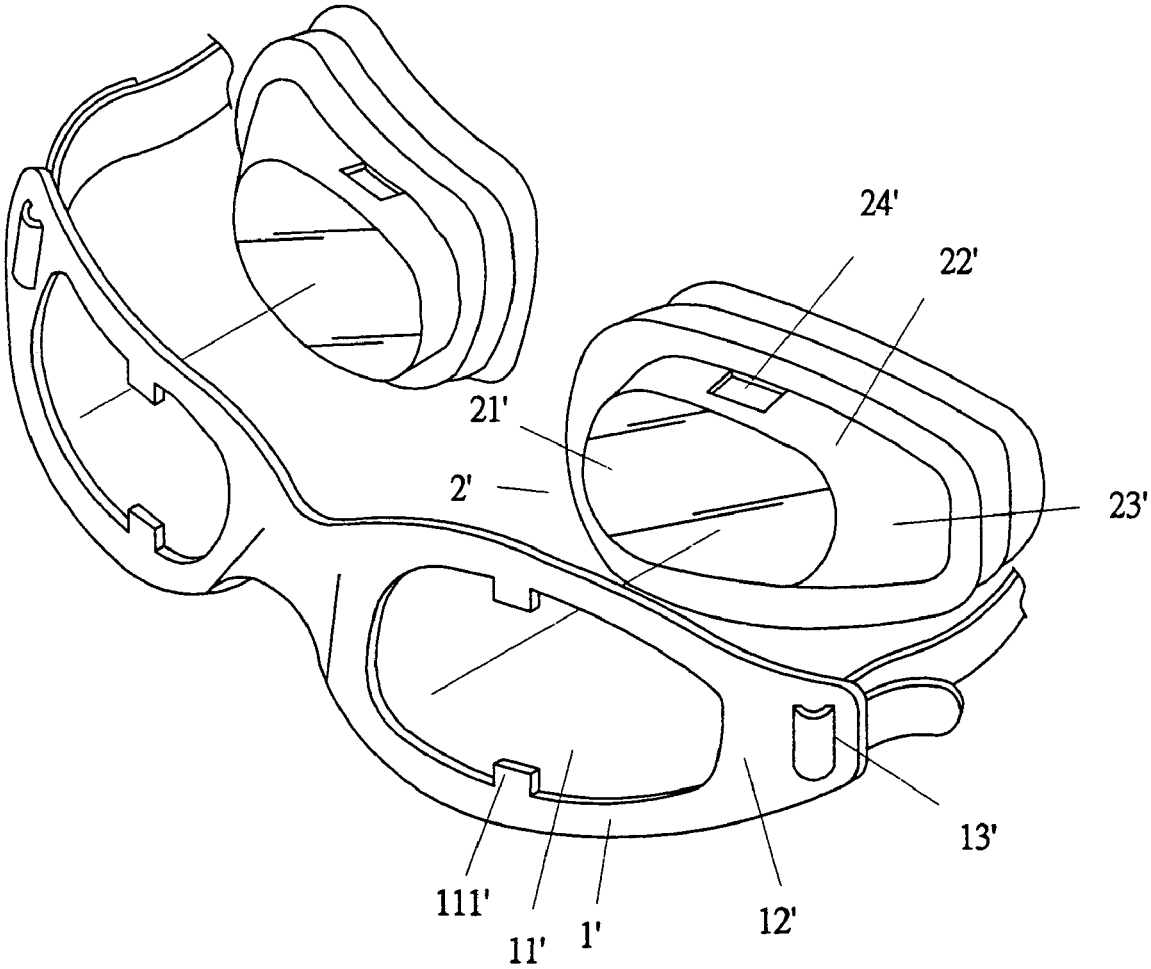
F I G . 7(PRIOR ART)
FIG. 7 is an exploded perspective view of a pair of conventional swimming goggles.
Figure 8:
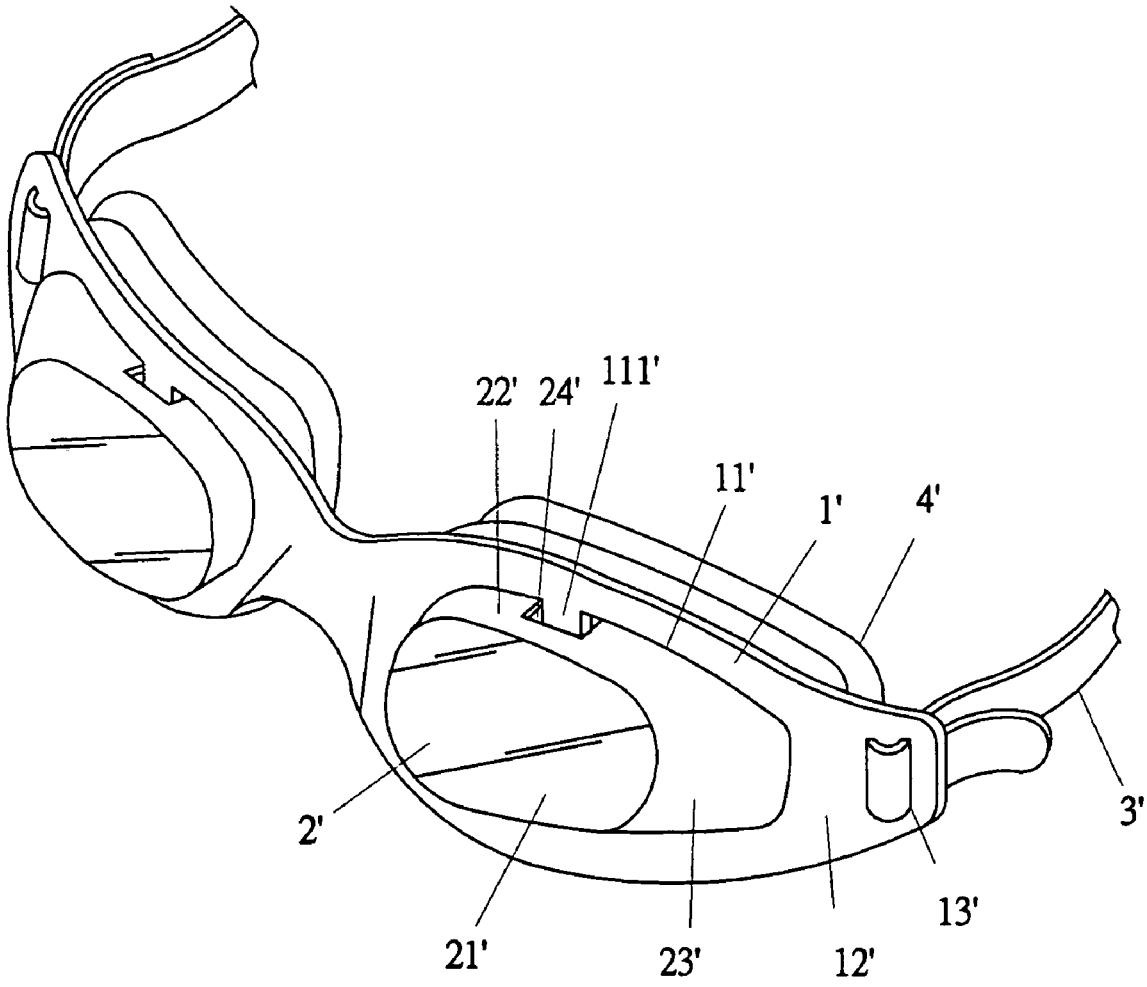
F I G . 8(PRIOR ART)
FIG. 8 is a perspective view of the pair of conventional swimming goggles in FIG. 7.
Figure 9:
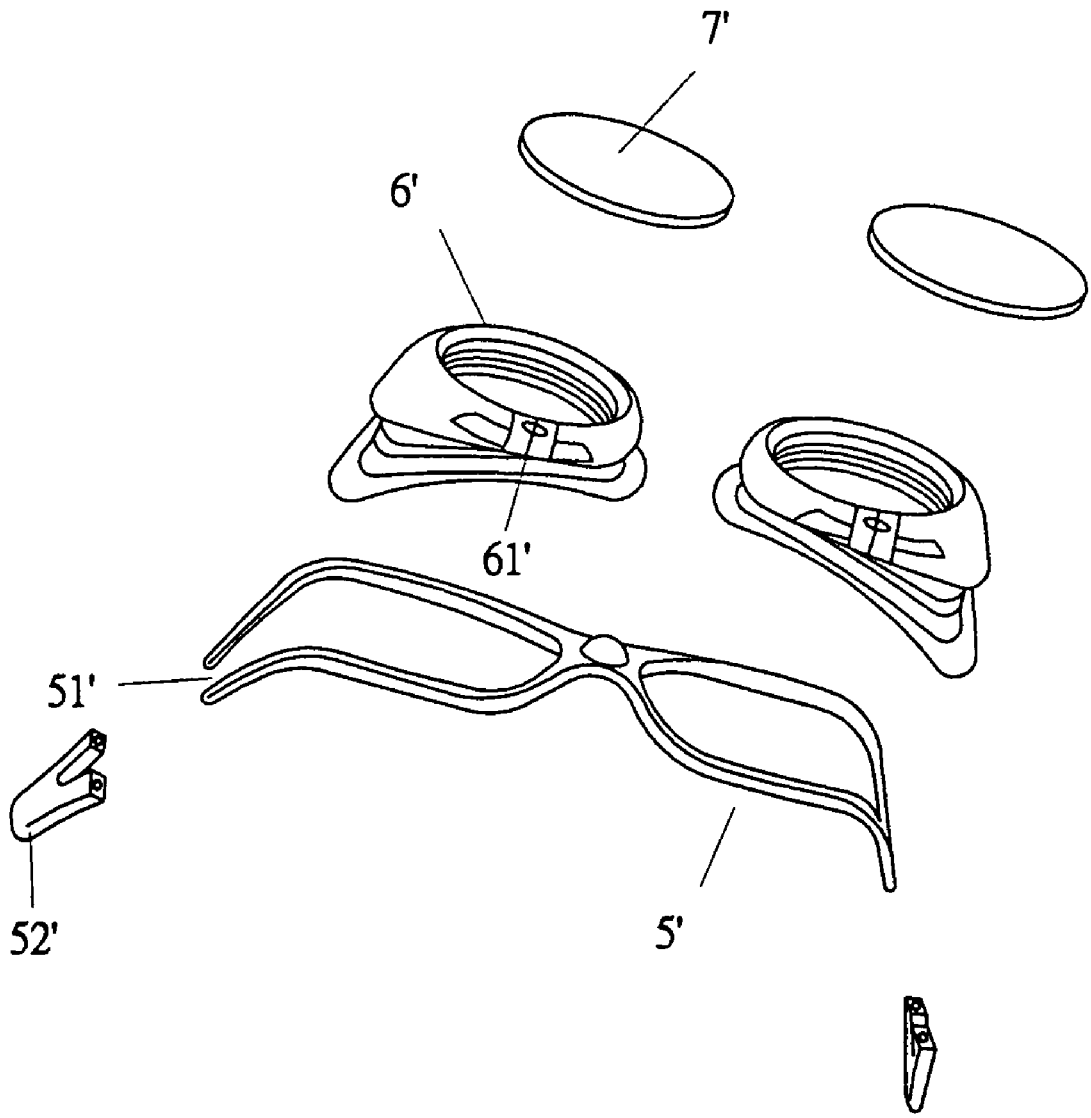
F I G . 9(PRIOR ART)
FIG. 9 is an exploded perspective view of another pair of conventional swimming goggles.
Figure 10:
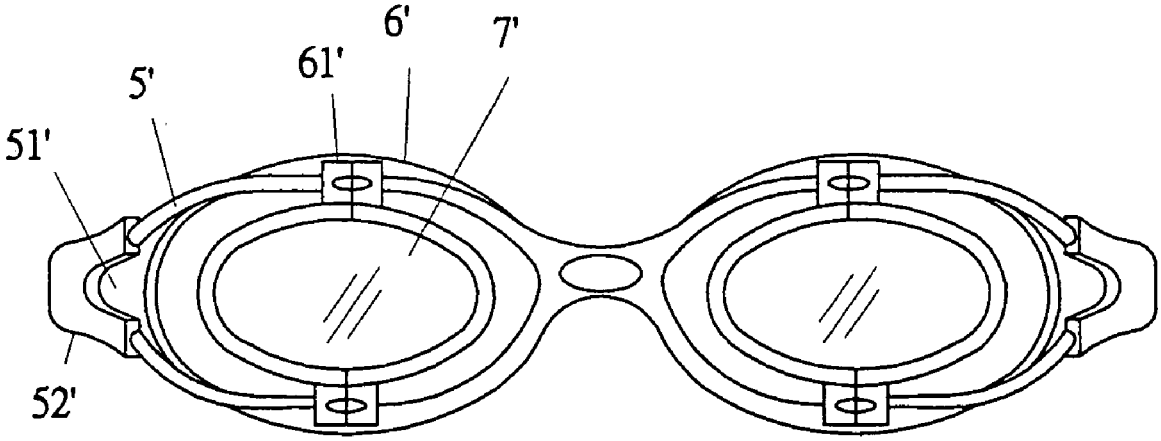
F I G . 10(PRIOR ART)
FIG. 10 is a front view of the pair of conventional swimming goggles in FIG. 9.
Figure 11:
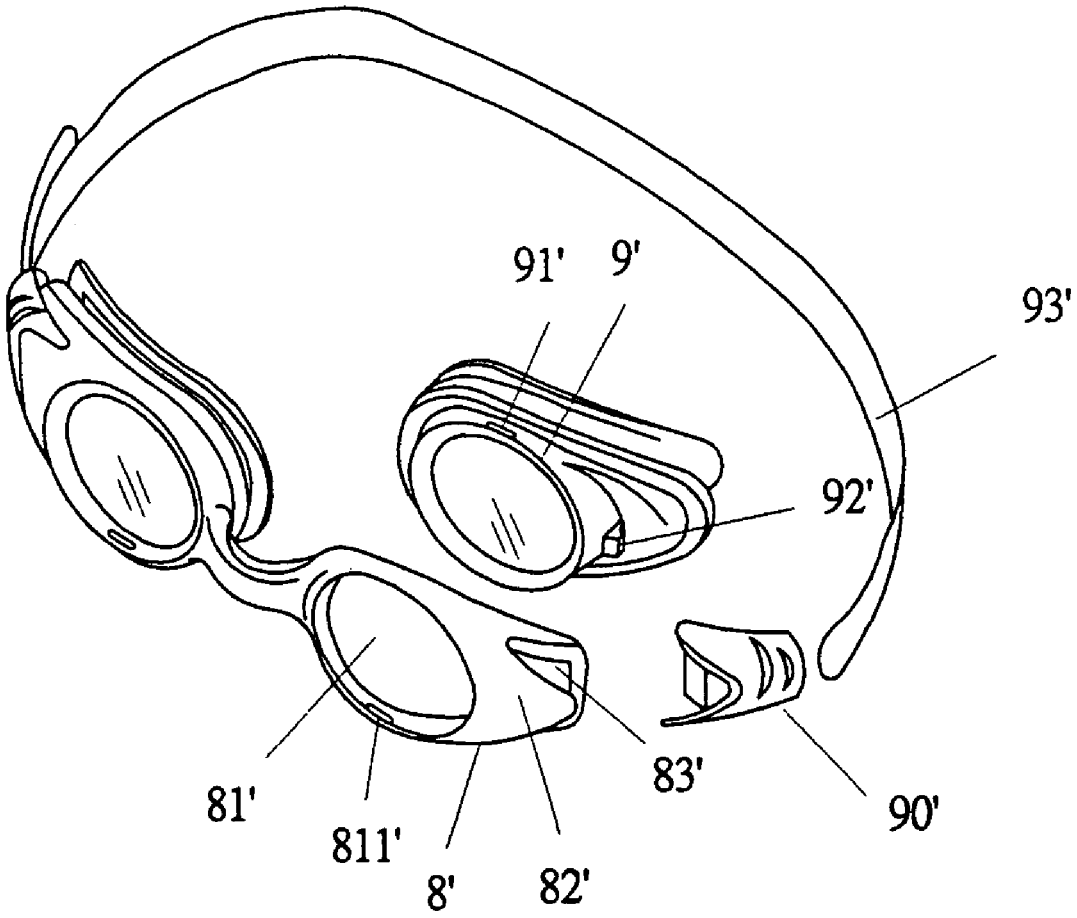
F I G . 11(PRIOR ART)
FIG. 11 is an exploded perspective view of a further pair of conventional swimming goggles.

FIG. 6 illustrates a modified embodiment of the invention, wherein the frames (now designated by 6) and the bridge (now designated by 7) may be integrally formed as one piece. Further, each end of the head strap includes a buckle 8 for coupling with an outer section (now designated by 61) of the associated frame 6.

As apparent from the forging description, the present invention provides a frame/lens combination for forming a pair of swimming goggles with improved assembling convenience, improved utility, and reduced swimming resistance.

Although specific embodiments have been illustrated and described, numerous modifications and variations are still possible without departing from the essence of the invention. The scope of the invention is limited by the accompanying claims.

What is claimed is:

1. A pair of swimming goggles, comprising:

two rigid frames with stretching resistance, the frames being connected with each other, each said frame being annular and including an opening, the opening tapering outward to form a tapered end section, the tapered end section being delimited by a perimeter wall that has an outer section;

two rigid lenses with stretching resistance, each said lens being held in the opening of an associated one of the frames, each said tapered end section defining a space between each said lens and the associated frame; and a head strap including two ends, each said end of the head strap being engaged with the outer section of the perimeter wall that defines the tapered end section of the opening of an associated one of the frames, at least a portion of each said end of the head strap being received in an associated one of the spaces.

2. The pair of swimming goggles as claimed in claim 1, wherein each said end of the head strap wraps around and is thus engaged with the outer section of the perimeter wall of an associated one of the frames.

3. The pair of swimming goggles as claimed in claim 1, wherein each said end of the head strap includes a buckle engaged with the outer section of the perimeter wall of an associated one of the frames.

4. The pair of swimming goggles as claimed in claim 1, wherein the tapered end section of each said opening has a width smaller than that of an associated one of the lenses.

5. The pair of swimming goggles as claimed in claim 1, wherein the perimeter wall of each said frame includes at least one engaging member, and wherein each said lens includes at least one engaging groove engaged with said at least one engaging member of an associated one of the frames.

6. The pair of swimming goggles as claimed in claim 1, wherein each said lens further includes an outer inclined section.

7. The pair of swimming goggles as claimed in claim 5, wherein each said lens further includes an outer inclined section.

8. The pair of swimming goggles as claimed in claim 5, wherein each said end of the head strap includes a buckle engaged with the outer section of the perimeter wall of an associated one of the frames.

* * * * *